US006218781B1

(12) United States Patent
Genz et al.

(10) Patent No.: US 6,218,781 B1
(45) Date of Patent: Apr. 17, 2001

(54) LONG-LASTING METAL HALIDE DISCHARGE LAMP

(75) Inventors: Andreas Genz; Hans-Werner Gölling, both of Berlin (DE)

(73) Assignee: Patent-Treuhand-Gesellschaft für Elektrische Glühlampen mbH, Munich (DE)

( * ) Notice: Subject to any disclaimer, the term of this patent is extended or adjusted under 35 U.S.C. 154(b) by 0 days.

(21) Appl. No.: 09/202,087

(22) PCT Filed: Apr. 20, 1998

(86) PCT No.: PCT/DE98/01097

§ 371 Date: Dec. 8, 1998

§ 102(e) Date: Dec. 8, 1998

(87) PCT Pub. No.: WO98/48446

PCT Pub. Date: Oct. 29, 1998

(30) Foreign Application Priority Data

Apr. 21, 1997 (DE) ..... 197 16 462

(51) Int. Cl.[7] ..... H01J 17/20
(52) U.S. Cl. ..... 313/637; 313/571
(58) Field of Search ..... 313/637, 620, 313/571, 638, 639

(56) References Cited

U.S. PATENT DOCUMENTS 5,138,229 * 8/1992 Honda et al. ..... 313/628
5,323,085 6/1994 Genz .
5,691,601 * 11/1997 Frey et al. ..... 313/637

FOREIGN PATENT DOCUMENTS 492 205 7/1992 (EP) .

OTHER PUBLICATIONS

*Derwent Abstracts* AN 97–032850, XP–002079972, Database WPI, Section CH, Week 9703, Apr. 20, 1996, of RU 2058620C.

*Patent Abstracts of Japan*, vol. 017, No. 340, Jun. 28, 1993, of JP 050047348, Toshiba Lighting & Technol. Corp., Feb. 26, 1993.

*Patent Abstracts of Japan*, vol. 004, No. 083, Jun. 14, 1998, of JP 55050567, Toshiba Corp., Apr. 12, 1980.

* cited by examiner

*Primary Examiner*—Nimeshkumar D. Patel
*Assistant Examiner*—Todd Reed Hopper
(74) *Attorney, Agent, or Firm*—Frishauf, Holtz, Goodman, Langer & Chick, P.C.

(57) ABSTRACT

A metal halide discharge lamp having a bulb which contains a fill including an ignition gas, mercury, a halogen, lithium, indium, thallium and tin, and which is devoid of a rare earth element. Such fill serves to lengthen the service life of the lamp. The lamp is especially suitable for effect lighting.

13 Claims, No Drawings

LONG-LASTING METAL HALIDE DISCHARGE LAMP

BACKGROUND OF THE INVENTION

1. Field of the Invention

The invention relates to a metal halide discharge lamp In particular, the present invention relates to a metal halide discharge lamp for use in the field of effect lighting, that is, with color temperatures above the so-called "daylight" temperature of 4200 K and with medium arc lengths.

2. Background Information

Metal halide discharge lamps are preferably used for lighting fixtures in architectural and effect lighting, and thus are particularly for accent lighting of defined areas, such as in houses and apartments, in galleries, or for social or professional occasions, to provide emphasis and lighting that is brighter than ambient light. The demands made in this field, in terms of the optical properties of the light, and in particular the location where the light is generated, the luminous flux referred to the power of the lamp, and the color temperature, can be classified somewhere between the needs of general lighting and specialized requirements, such as for projection purposes.

Although somewhat more stringent demands in terms of the aforementioned technical characteristics are made of such lamps, compared with the general lighting field, still in the field of effect lighting it is quite important to strive for the longest possible service life, so as to lessen the cost of replacement bulbs and the labor of replacing them, as well as to make the lamps reliable and maintenance-free.

Good color reproduction and the correct color temperature are important goals as well.

SUMMARY OF THE INVENTION

An object of the invention, is to provide a metal halide discharge lamp having a lengthened preamble to claim 1, is to lengthen the service life.

This object is attained by a metal halide discharge lamp having a color temperature of over 4800° K. and comprising a bulb and a fill disposed therein, the fill comprising an ignition gas, mercury, a halogen, lithium, indium, thallium and tin, and is devoid of a rare earth element.

As its point of departure, the invention first assumes that devitrification,—that is, the progressive crystallization of the bulb of a metal halide discharge lamp,—is an essential determinant of its service life. The invention therefore contemplates a fill without any rare earth element, because the rare earth elements have proven to be a substantial cause of the devitrification phenomenon as the lamp increases in age.

Because the invention dispenses with a rare earth element, an additional advantageous effect,—in addition to the increase in service life because there is less devitrification, is a decreased tendency to blackening of the inside wall of the lamp bulb. In view of the fundamental object stated above, this effect can be exploited to reduce the wall load. To this end, either the bulb can be larger, for a specified electrical power consumption of the lamp, or for a specified bulb size, the power consumption can be reduced. Until now, this was not conventionally possible except at the cost of the blackening problems that then ensued. The low wall load additionally lessens the tendency to devitrification, and thus, beyond the already-described effect of dispensing with rare earth elements, improves devitrification and hence improves the service life of the lamp.

The described effects of the invention can be realized with a fill that along with the conventional components of ignition gas, mercury, and halogen, contains lithium, indium, thallium, and tin. Lithium provides for the red component, indium for the blue component, and thallium for the green component in the radiation produced by the lamp. All three elements project essentially spectral lines, so that according to the invention tin is used so as to achieve a good continuum between the lines, especially at low power and with a low wall load. The result of the definitive characteristics of the present invention, taken all in all, is a metal halide discharge lamp that has the desired spectral composition of the light produced, as well as a very markedly improved service life.

Lamps with a color temperature of over 4800° K. and even better over 5000° K. are preferred. As already explained, the arc length is in the medium range, corresponding to the particular lamp power; in particular, the specific power, referred to the arc length, may range between 40 and 80 W/mm, depending on the embodiment. A preferred range for the possible wall load, reduced by means of the invention, is between 30 and 60 W/cm$^2$.

To allow setting the color temperature high, it may also be provided according to the invention that the lamp fill not contain any sodium. It is particularly preferred that aside from those mentioned, no other components whatever are present in the fill, except for the usual traces.

The preferred halogens are the conventionally known elements, iodine and bromine; that is, the aforementioned metals, lithium, indium, thallium and tin, are added to the lamp in the form of iodides and/or bromides. Conventionally, to prevent excessive blackening of the lamp, some of the mercury is also added in the form of iodide or bromide. In the invention, this provision is unnecessary in the lamp fill, which is an additional advantage. The mercury can thus be added in elemental form, and the halogen can be added stoichiometrically with respect to the halides of the elements lithium, indium, thallium and tin, or may be added only in the form of the halides of these elements. For production, this has the advantage that at least one less component is included, namely the mercury iodide, mercury bromide or in general, mercury halide.

The following concentration ranges for the four elements namely, lithium, indium, thallium and tin have proved to be advantageous:

lithium: 0.15–3.0 $\mu$mol/ml, and especially 0.15–1.5 $\mu$mol, indium: 0.2–2.0 $\mu$mol/ml, thallium: 0.05–0.5 $\mu$mol/ml, and tin: 0.5–5.0 $\mu$mol/ml.

The aforementioned concentration ranges are advantageous not only in the full combination, but also individually and independently of one another, as well as in subsidiary combinations.

An advantageous field in which the invention can be employed is the power range from 200 to 2500 W per lamp, but it may also be employed outside this range. As already explained at the outset, it is suitable especially for the effect lighting market, where somewhat lesser demands for color location and light density prevail than for such special applications as in filming, or projection. Yet precisely in the effect lighting field, the markedly improved service life makes itself felt as an essential economic advantage.

Commercially available lamps are often equipped with an extra outer bulb. Between the outer and inner bulbs, special gas fills can be used, instead of a vacuum. The invention is equally well suited to lamps with or without an outer bulb.

The outer bulb may be advantageous for the sake of touch protection, for instance, if an inner bulb that is intrinsically provided with two terminals on two opposed ends is to be used in a lamp that needs to be connected on only one end. Then one of the two terminals of the inner bulb must be guided to the other end along the outer wall of the inner bulb, and an outer bulb is provided as touch protection. Finally, the improved explosion protection can be one reason to choose a lamp with an outer bulb.

Exemplary Embodiments

A first concrete exemplary embodiment is designed as follows:

A 300 W lamp has a mean arc length of 5 mm. It is designed for operation without an outer bulb and has a bulb volume of 1.1 ml. If an outer bulb were used, the color temperature would be lowered somewhat because of the increase in the wall temperature. To compensate, the wall load would be decreased (that is, the lamp power would be reduced, or the inner bulb would be made larger), and/or the proportion of lithium iodide would be reduced, so that the desired color temperature could be achieved. In the present example, this is 5500° K.

At an ignition gas pressure of 300 mbar of argon, 45 mg of mercury are used. The other components are 0.4 mg of lithium iodide (equivalent 2.72 $\mu$mol of lithium per ml), 0.32 mg of indium iodide (equivalent to 1.2 $\mu$mol of indium per ml), 0.14 mg of thallium iodide (equivalent to 0.384 $\mu$mol of thallium per ml), and 0.85 mg of $SnBr_2$ (equivalent to 2.775 $\mu$mol of tin per ml).

With this lamp, a luminous flux of 21 klm was attained. The service life is over 2000 hours.

Another concrete exemplary embodiment is designed as follows:

Another 300 W lamp has a mean arc length of 5 mm. It is designed for operation without an outer bulb and has a bulb volume of 1.5 ml. The color temperature is 6100° K.

At an ignition gas pressure of 300 mbar of argon, 45 mg of mercury are used. The other components are 0.04 mg of lithium iodide (equivalent to 0.2 $\mu$mol of lithium per ml), 0.63 mg of indium iodide, 0.12 mg of thallium iodide, and 0.67 mg of $SnBr_2$.

With this lamp, a luminous flux of 22.5 klm was attained. The service life is again over 2000 hours.

The spatial/physical design is conventional and corresponds for instance to the form described in European Patent Application 91 120 910.4, published under the number 0 492 205 A2. This published application is hereby incorporated by reference.

What is claimed is:

1. A metal halide discharge lamp having a color temperature over 4800° K., the lamp comprising a bulb and a fill disposed in said bulb, said fill consisting essentially of an ignition gas, mercury, a halogen, lithium, indium, thallium and tin, said fill being devoid of a rare earth element and sodium.

2. The lamp of claim 1, with a color temperature of over 5000° K.

3. The lamp of claim 1, having a specific power, referred to the arc length, of 40 to 80 W/mm.

4. The lamp of claim 1, having a wall load of 30 to 60 W/cm$^2$.

5. The lamp of claim 1, wherein the halogen is contained in the fill in an amount that is stoichiometric with respect to halides of the lithium, indium, thallium and tin, with the mercury being in elemental form.

6. The lamp of claim 1, wherein the lithium is in an amount of 0.15–3.0 $\mu$mol/ml, the indium is in an amount of 0.2–2.0 $\mu$mol/ml, the thallium is in an amount of 0.05–0.5 $\mu$mol/ml and the tin is in an amount of 0.5–5.0 $\mu$mol/ml.

7. The lamp of claim 6, wherein the lithium is in an amount of 0.15 to 1.5 $\mu$mol.

8. The lamp of claim 6, wherein the lithium is in the form of lithium iodide, the indium is in the form of indium iodide, the thallium is in the form of thallium iodide and the tin is in the form of tin bromide.

9. The lamp of claim 1, wherein the halogen, lithium, indium, thallium and tin are in the form of halides of lithium, indium, thallium and tin.

10. The lamp of claim 9, wherein the halide is selected from the group consisting of an iodide and a bromide.

11. The lamp of claim 1, wherein the lamp has (i) a color temperature of over 5000° K., (ii) a specific power, referred to the arc length, of 40 to 80 W/mm and (iii) a wall load of 30 to 60 W/cm$^2$.

12. A metal halide discharge lamp having a color temperature over 4800° K., the lamp comprising a bulb and a fill disposed in said bulb, said fill consisting essentially of argon, mercury, a lithium halide, an indium halide, a thallium halide and a tin halide, said fill being devoid of a rare earth element and sodium.

13. The lamp of claim 12, wherein the lamp has (i) a color temperature of over 5000° K., (ii) a specific power, referred to the arc length, of 40 to 80 W/mm and (iii) a wall load of 30 to 60 W/cm$^2$.

* * * * *